US005139643A

United States Patent [19]

Roling et al.

[11] Patent Number: 5,139,643

[45] Date of Patent: Aug. 18, 1992

[54] PHOSPHORUS DERIVATIVES OF POLYALKENYLSUCCINIMIDES AND METHODS OF USE THEREOF

[75] Inventors: Paul V. Roling, Spring; David R. Forester, Conroe; Bruce E. Wright, The Woodlands, all of Tex.

[73] Assignee: Betz Laboratories, Inc., Trevose, Pa.

[21] Appl. No.: 668,548

[22] Filed: Mar. 13, 1991

[51] Int. Cl.[5] ..... C10G 9/16

[52] U.S. Cl. ..... 208/48 AA; 208/48 R; 585/950

[58] Field of Search ..... 208/48 R, 48 AA, 279; 585/950

[56] References Cited

U.S. PATENT DOCUMENTS

| | | | |
|---|---|---|---|
| 3,172,892 | 3/1965 | LeSuer | 260/326.5 |
| 3,235,484 | 2/1966 | Colfer | 208/48 |
| 3,437,583 | 4/1969 | Gonzalez | 208/48 |
| 4,024,051 | 5/1977 | Shell | 208/348 |
| 4,578,178 | 3/1986 | Forester | 208/48 |
| 4,681,965 | 7/1987 | Speranza et al. | 558/162 |
| 4,775,458 | 10/1988 | Forester | 208/48 |
| 4,775,459 | 10/1988 | Forester | 208/48 |
| 4,828,674 | 5/1989 | Forester | 208/48 |

*Primary Examiner*—Theodore Morris
*Assistant Examiner*—William C. Diemler
*Attorney, Agent, or Firm*—Alexander D. Ricci; Bruce E. Peacock

[57] ABSTRACT

Phosphorus derivatives of polyalkenylsuccinimides and methods of use of such derivatives as antifoulants in liquid hydrocarbonaceous mediums, such as crude oil, during processing at elevated temperatures are disclosed. The derivatives are formed via reaction of a polyalkenylsuccinimide intermediate with formaldehyde and a phosphorus compound having at least one acidic hydrogen P—H bond. The intermediate is first formed via reaction of polyalkenylsuccinic anhydride and polyamine.

10 Claims, No Drawings

PHOSPHORUS DERIVATIVES OF POLYALKENYLSUCCINIMIDES AND METHODS OF USE THEREOF

FIELD OF THE INVENTION

The present invention pertains to phosphorus-containing derivatives of polyalkenylsuccinimides and to the use of same to inhibit fouling in liquid hydrocarbon mediums.

BACKGROUND OF THE INVENTION

In the processing of petroleum hydrocarbons and feedstocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 100° to 1000° F., frequently from 600°-1000° F. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, phosphorus containing derivatives of polyalkenylsuccinimides are disclosed and used to inhibit fouling of liquid hydrocarbon mediums. Typically, such antifoulant protection is provided during heat processing of the medium, such as in refinery, purification, or production processes.

The polyalkenylsuccinimides may be prepared by reacting a polyalkenylsuccinic anhydride with a polyamine, preferably ethylenediamine or a polyethyleneamine to form a polyalkenylsuccinimide. A wide variety of polyalkenylsuccinimides are also commercially available. A phosphorus compound, having at least one acidic P—H bond, is then reacted with the polyalkenylsuccinimide in the presence of formaldehyde to form the desired derivative.

PRIOR ART

Over the years, a variety of products have been provided by various chemical suppliers to inhibit fouling in liquid hydrocarbonaceous mediums. Particularly successful are the polyalkenylthiophosphonic acid esters disclosed in U.S. Pat. No. 4,578,178 (Forester) and the Group II(a) cation salts thereof specified in U.S. Pat. No. 4,775,459 (Forester). In U.S. Pat. No. 4,024,051 (Shell), inorganic phosphorus-containing acids and/or salts thereof are taught as useful antifoulants.

In U.S. Pat. No. 3,437,583 (Gonzalez), combinations of metal deactivator, phenolic compound, and substituted succinic acid or anhydride are used to inhibit fouling in hydrocarbon process fluids. Amine reaction products of succinic acid and succinic anhydride are reported in U.S. Pat. No. 3,235,484 (Colfer et al) as being useful in inhibiting the accumulation of harmful carbonaceous material in refinery cracking units. In U.S. Pat. No. 3,172,892 (LeSuer et al), reaction of succinic acid and/or its anhydride with ethylenediamines to form succinimides is taught. The reaction products are used as dispersants in lubricating compositions. Boron-containing reaction products of aliphatic olefin polymer-succinic acid-amine compounds are reported in U.S. Pat. No. 3,087,936, as being useful additives in lubricants for use in internal combustion engines, gears, and power transmitting units.

U.S. Pat. No. 4,681,965 (Speranza et al) teaches reaction of phosphorus compounds, specifically dialkylphosphites, having an acidic P—H bond, with Mannich products formed via reaction of a phenol, formaldehyde, and a primary amine. The disclosed phosphorus derivatives are useful as fire retardants, lubricant additives, gasoline wear-inhibiting additives, corrosion inhibitors and surfactants.

Additional patents of interest to the field of antifoulant treatment include U.S. Pat. Nos. 4,775,458 (Forester et al); and 4,828,674 (Forester).

DETAILED DESCRIPTION OF THE PREFERRED EMBODIMENT

We have found that phosphorus derivatives of polyalkenylsuccinimides provide significant antifoulant efficacy in liquid hydrocarbonaceous mediums. It is to be understood that the phrase "liquid hydrocarbonaceous medium" as used herein signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The phosphorus derivatives of polyalkenylsuccinimide useful in the invention are generally prepared from reaction of polyalkenylsuccinic anhydride (PIBSA) with a polyamine with attendant heating to drive off water so as to form the requisite polyalkenylsuccinimide intermediate. After the intermediate is formed, it is reacted with a formaldehyde source, e.g., paraformaldehyde and phosphorus compound containing at least one acidic P—H bond to yield the desired reaction product.

More specifically, the starting reactant, polyalkenylsuccinic anhydride may be purchased commercially or prepared. Presently, it is preferred to buy this from Texaco. One such commercially sold polyalkenylsuccinic anhydride is sold under the trademark TLA-627. It is a polyisobutenylsuccinic anhydride having the structure

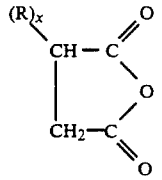

(I)

wherein, in this case, R is an isobutenyl repeat unit. The average molecular weight of the polyisobutene used to produce the PIBSA is about 1300.

The precursor polyalkenylsuccinic anhydride may also be prepared as reported in U.S. Pat. No. 3,235,484 (Colfer), incorporated herein by reference. As is stated in the '484 patent, the anhydrides may be prepared by reaction of maleic anhydride with a high molecular weight olefin or a chlorinated high molecular weight olefin at reaction temperatures of from 150°-200° C. As is further stated in the Colfer disclosure, the general scheme is

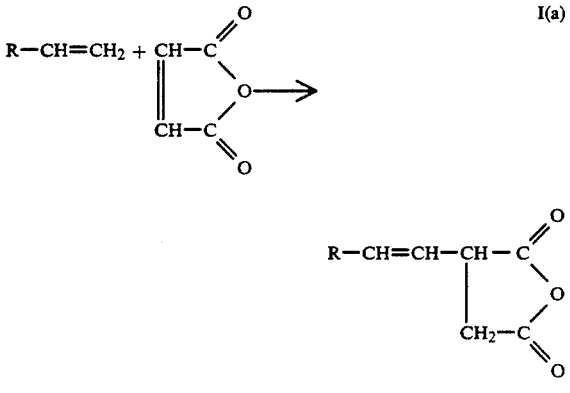

I(a)

OR

-continued

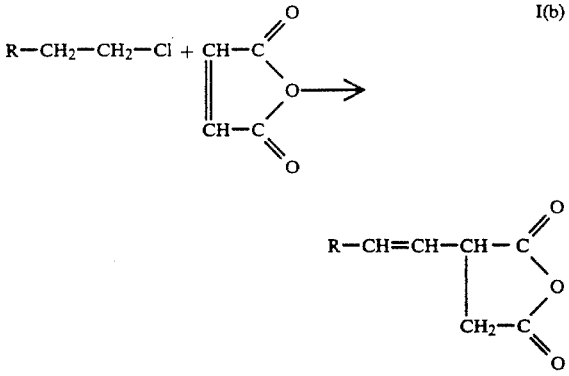

I(b)

Even though for the most part, the R grouping comprises an alkenyl moiety, Colfer points out that this substituent can be either an aliphatic alkyl or alkenyl moiety. For ease of reference, the compounds having such R groupings are referred to herein as polyalkenyl compounds, although in the strict sense they should be referred to as aliphatic alkyl or alkenyl moieties.

The most commonly used sources for forming the aliphatic R substituent on the succinic anhydride compound are the polyolefins, such as polyethylene, polypropylene, polyisobutene, polyamylene, polyisohexylene, etc. The most particularly preferred polyolefin (and the one used to manufacture the polyisobutenylsuccinic anhydride from Texaco) is polyisobutene. As Colfer states, particular preference is made for such a polyisobutene-containing at least about 50 carbon atoms, preferably from at least 60 carbon atoms and most desirably from about 100 to about 130 carbon atoms. Accordingly, an operable carbon atom number range for R is from about 30-200 carbon atoms.

Once the polyalkenylsuccinic anhydride presursor is obtained, it is reacted with a polyamine, as reported in Colfer, at temperature in excess of about 80° C. so as to form an imide. More specifically, the polyalkenylsuccinic anhydride

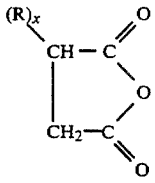

(I)

wherein R is an aliphatic alkenyl or alkyl moiety having at least about 50 carbon atoms and less than about 200 carbon atoms, is reacted with a polyamine having the structure

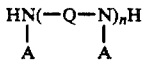

(II)

in which n is an integer, A is chosen from hydrocarbyl, hydroxyalkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is alkylene, such as ethylene, trimethylene, tetramethylene, etc. Q is most preferably ethylene.

Accordingly, exemplary amine components may comprise ethylenediamine, triethylenetetramine, diethylenetriamine, trimethylenediamine, di-(trimethylene)-triamine, tris-(trimethylene)tetramine, tri-(hexamethylene)tetramine, decamethylene diamine, N-octyl trimethylene diamine, N,N'-dioctyl trimethylene diamine, N-(2-hydroxyethyl)ethylene diamine, piperazine, 1-(2-aminopropyl)piperazine, 1,4-bis-(2-aminoethyl)piperazine, 1-(2-hydroxyethyl)piperazine, di-(hydroxypropy)substituted tetraethylene pentamine, N-3-(hydroxypropyl)tetramethylene diamine, pyrimidine, 2-methyl-imidazoline, polymerized ethylene imine, and 1,3-bis-(2-aminoethyl)imidazoline.

The reaction of precursor polyalkenyl succinic anhydride with amine (II) is conducted at temperature in excess of 80° C. with use of a solvent, such as benzene, xylene, toluene, naphtha, mineral oil, n-hexane, etc. Preferably, the reaction is conducted at from 100°-250° with a molar amount of precursor anhydride (I): amine (II) being from about 1:5 to about 5:1 with a molar amount of 1:1 being preferred.

After the polyalkenylsuccinimide has been prepared, it can be isolated by conventional techniques and then reacted with the desired phosphorus containing compound having at least one acidic P—H bond and aldehyde in a solvent medium such as described above, or the reaction medium used to produce the intermediate may be used with the desired phosphorus compound and aldehyde simply added thereto to form the phosphorus reaction product useful in the invention.

As to the phosphorus component (III) that is to be reacted with the polyalkenylsuccinimide intermediate, this may generally be described as having an acidic P—H bond to undergo reaction with an N—H bond in the presence of formaldehyde. Exemplary phosphorus compounds can therefore be classified as:

1. phosphonic acid

FORMULA III(a)

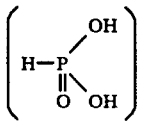

[frequently called phosphorous acid] and organic esters thereof

FORMULA III(b)

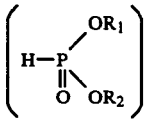

wherein $R_1$ and $R_2$ are independently chosen from $C_1$-$C_8$ alkyl; and 2. phosphonic acid FORMULA III(c)

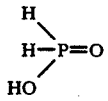

[also called hypophosphorus acid] and organic esters thereof

FORMULA III(d)

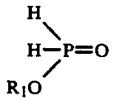

wherein $R_1$ is the same as above.

More preferably, the phosphorus compound is a dialkylphosphite of the structure

FORMULA III(b)

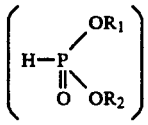

as above. Dimethylphosphite ($R_1$ and $R_2$=Me) and diethylphosphite ($R_1$ and $R_2$=Et) are most clearly preferred.

The reaction of the polyalkenylsuccinimide and phosphorus compound (IIIa-d) is carried out in the presence of an aldehyde having the structure (IV)

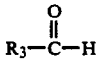

wherein $R_3$ is selected from hydrogen and alkyl having 1-6 carbon atoms. Preferably, the aldehyde comprises either formaldehyde or paraformaldehyde. This reaction may be undertaken at temperatures of from about 100°-200° C. Preferably, the phosphorus compound is added in at least an equimolar amount to the polyalkenylsuccinimide compound or anhydride form precursor thereof. The aldehyde is added in a molar amount that is about equal to the number of moles of the phosphorus compound used. The phosphorus derivative containing reaction products of the invention may then be isolated via convention techniques or they may be used, as is, in the reaction medium.

The phosphorus derivatives of the invention that are useful in antifoulant treatments in liquid hydrocarbonaceous mediums have the structure (V)

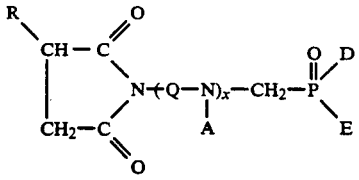

wherein R is an aliphatic alkyl or alkenyl moiety having from about 30 to 200 carbon atoms; preferably R is greater than 50 carbon atoms. Q is a divalent aliphatic radical and x is a positive integer. A is chosen from hydrogen hydrocarbyl, or hydroxyalkyl. D and E are independently chosen with D being selected from the group consisting of H, OH, or $OR_1$, wherein $R_1$ is selected from $C_1$-$C_8$ alkyl and with E being selected from H, OH, or $OR_2$ wherein $R_2$ is $C_1$-$C_8$ alkyl. More preferably, Q is chosen from ethylene, trimethylene, tetramethylene, and pentamethylene. Most preferably, x is 1 and Q is ethylene.

When the preferred dialkyl phosphite esters are used as the phosphorus source, the resulting compounds have the structure

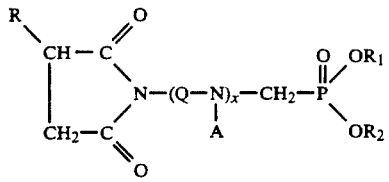

(VI)

with R, Q, A, x, $R_1$ and $R_2$ as defined above in conjunction with Formula V. Molecular weight of the compound V is not critical. The important criterion is that the compound be dispersible or soluble in the hydrocarbon liquid in need of antifouling protection. Molecular weights for the compound V may therefore fall within a very broad range of about 1,000–5,000 with an even narrower range of about 1,000–2,500 being even more preferred.

At present, the compound preferred for use is

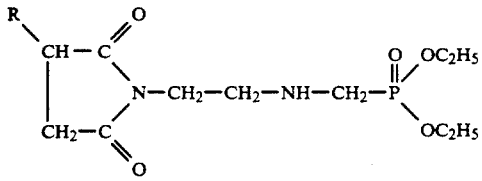

(VII)

The so formed phosphorus derivative compounds may be added to or dispersed within the liquid hydrocarbonaceous medium in need of antifouling protection in an amount of 0.5–10,000 ppm based upon one million parts of the liquid hydrocarbonaceous medium. Preferably, the antifoulant is added in an amount of from about 1 to 2500 ppm.

The phosphorus derivatives may be fed neat or dissolved in a non-polar organic solvent such as heavy aromatic naphtha, toluene, or xylene.

As the ensuing examples indicate, the phosphorus derivatives of the invention have proven especially effective in inhibiting fouling tendencies of various crude oils processed at temperatures from about 400°–1000° F.

Even more surprising is the efficacy of the antifoulants in performing well even in those crudes in which additional known fouling contaminants, such as asphaltene-containing residua, sulfur, mercaptans and metal naphthenates were added to the crude oil charge. These contaminants have been shown, in past field trials, to increase fouling tendencies of tested crudes. The contaminants, when encountered, may be present in the hydrocarbon medium in amounts of from 1–2500 ppm, based upon one million parts of the hydrocarbon.

The following examples are included as being illustrative of the invention and should not be construed as limiting the scope thereof.

PIBSAP Preparation

In a 250 mL, two-necked round bottomed flask were mixed with stirring 107.0 g (0.037 mol) of a 45% active solution of polyisobutenylsuccinic anhydride and 50 ml xylene. The mixture was heated to 92° C. and 2.2 g (0.037 mol) of ethylene diamine was added. The pot temperature was raised to 166° C. over 45 min. and about 1 ml of water and 16 ml of xylene were removed in a Dean-Stark trap. The temperature was lowered to 92° C., 17 mL of xylene was added to the flask followed by 4.0 mL (0.037 mol) of diethylphosphite and 1.1 g (0.037 mol) of paraformaldehyde. The mixture was heated to 157° C. over 1 hour and water and/or ethanol (1 mL) was collected in a Dean-Stark trap. The resulting solution amounted to 154.0 g of product (≈37% active). The product was designated as PIBSAP to denote a phosphorus derivative of polyisobutenylsuccinimide having the structure shown in VI, supra.

Efficacy

In order to ascertain the antifouling efficacy of the phosphite reaction products of polyisobutenylsuccinimide in accordance with the invention, test materials were subjected to a dual fouling apparatus test. In the dual fouling apparatus, process fluid (crude oil) is pumped from a Parr bomb through a heat exchanger containing an electrically heated rod. Then the process fluid is chilled back to room temperature in a water-cooled condenser before being remixed with the fluid in the bomb.

The Dual Fouling Apparatus (DFA) used to generate the data shown in the following Table contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\frac{\text{Avg. }\Delta\text{Area(control)} - \Delta\text{Area(treatment)}}{\text{Avg. }\Delta\text{Area(control)}} * 100 = \text{\% protection}$$

For DFA experiments where contaminants and antifoulants were added to the crude oil, the percent protection values for antifoulants were determined using the following equation $$\frac{\text{Avg. }\Delta\text{Area(contaminant)} - \Delta\text{Area(contaminant + antifoulant)}}{\text{Avg. }\Delta\text{Area(contaminant)}} \times 100$$

Antifouling protection in various crude oils was determined as shown in the following table.

TABLE I

| | | % Protection in Various Crude Oils | | | |
|---|---|---|---|---|---|
| Crude Designation | Rod Temp. °F. | Treatment Identification | ppm Active | % Protection | Comments |
| A | 800 | PIBSAP | 250 | 43 | 5 ml fractionator bottoms added* |

TABLE I-continued

| Crude Designation | Rod Temp. °F. | % Protection in Various Crude Oils: Treatment Identification | ppm Active | % Protection | Comments |
|---|---|---|---|---|---|
| A | 800 | PIBSAP | 87.5 | 53 | |
| A | 800 | PIBSAP | 125 | 43 | |
| B | 750 | PIBSAP | 250 | 62 | 5 ml fractionator bottoms added* |
| B | 800 | PIBSAP | 250 | 60 | |
| B | 800 | PIBSAP | 125 | 37 | |
| C | 650 | PIBSAP | 125 | 81, −29 | |
| C | 650 | PIBSAP | 87.5 | 37 | |
| C | 650 | PIBSA | 125 | 26, 46 | |
| D | 800 | PIBSAP | 370 | 58 | |
| D | 825 | PIBSAP | 250 | 37 | 30 ppm iron naphthenate added |
| D | 825 | PIBSAP | 250 | −18 | 1 gram elemental sulfur added |
| D | 825 | PIBSAP | 125 | 30 | 2,000 ppm sulfole mercaptan added to crude |
| D | 825 | PIBSAP | 125 | 15 | 2,000 ppm t-dodecyl mercaptan added to crude |
| D | 825 | PIBSAP | 125 | 33 | 10 ml fractionator bottoms added* |
| D | 825 | PIBSAP | 250 | 21 | 10 ml fractionator bottoms added* |
| E | 400 | PIBSAP | 125 | −2 | |
| F | 925 | PIBSAP | 62.5 | 10 | |
| F | 925 | PIBSAP | 250 | 52 | |
| F | 925 | PIBSAP | 432 | 34 | |

*asphaltene containing residuum
PIBSAP = the phosphorus-containing reaction product - prepared in accordance with PIBSAP preparation above, having a molecular weight of about 1,500, wherein R is an isobutenyl repeat moiety.
PIBSA = polyisobutenylsuccinic anhydride (MW ≈ 1300 of the PIB - polyisobutene) purchased from Texaco under the trademark TLA-627.

As shown in the Table, the PIBSAP material is an effective antifoulant in almost all of the crude oils tested.

In accordance with the patent statutes, the best mode of practicing the invention has been set forth. However, it will be apparent to those skilled in the art that many other modifications can be made without departing from the invention herein disclosed and described, the scope of the invention being limited only by the scope of the attached claims.

We claim:

1. A method of inhibiting fouling deposit formation in a liquid hydrocarbonaceous medium during heat treatment processing thereof, wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of a phosphorus containing compound, wherein said phosphorus containing compound comprises the structure

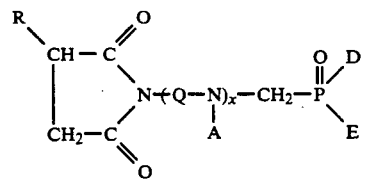

(V)

wherein R is an aliphatic alkyl or alkenyl moiety having from about 30–200 carbon atoms, Q is alkylene, x is a positive integer, A is chosen from hydrocarbyl, hydrogen, or hydroxy alkyl; D is selected from H, OH, and $OR_1$, wherein $R_1$ is $C_1$–$C_8$ alkyl, and E is selected from H, OH, and $OR_2$ wherein $R_2$ is $C_1$–$C_8$ alkyl; and heat treating said liquid hydrocarbon aceous medium.

2. Method as recited in claim 1 wherein R comprises more than 50 carbon atoms.

3. Method as recited in claim 2 wherein R comprises a polyalkenyl moiety.

4. Method as recited in claim 3 where in R comprises a repeated polyisobutenyl moiety.

5. Method as recited in claim 2 wherein Q is ethylene, A is H, and x is 1.

6. Method as recited in claim 5 wherein D is $OR_1$, and E is $OR_2$.

7. Method as recited in claim 6 wherein $R_1$ and $R_2$ are both ethyl.

8. Method as recited in claim 2 further comprising adding from about 0.5–10,000 parts by weight of said phosphorus-containing compound to said liquid hydrocarbonaceous medium based upon one million parts of said liquid hydrocarbonaceous medium.

9. Method as recited in claim 2 wherein said liquid hydrocarbonaceous medium comprises a crude oil.

10. Method as recited in claim 2 wherein said liquid hydrocarbonaceous medium is heated at temperatures of from about 400°–1000° F.

* * * * *